United States Patent [19]

Lautenschläger, Jr.

[11] Patent Number: 4,894,884

[45] Date of Patent: Jan. 23, 1990

[54] OVER-CENTER SELF-CLOSING HINGE FOR CABINET DOORS

[75] Inventor: Karl Lautenschläger, Jr., Reinheim, Fed. Rep. of Germany

[73] Assignee: Karl Lautenschläger GmbH & Co. KG, Fed. Rep. of Germany

[21] Appl. No.: 324,204

[22] Filed: Mar. 15, 1989

[30] Foreign Application Priority Data

Mar. 15, 1988 [DE] Fed. Rep. of Germany ..... 3808585

[51] Int. Cl.[4] ..... E05F 1/08

[52] U.S. Cl. ..... 16/278; 16/294; 16/296; 16/288

[58] Field of Search ..... 16/291, 294, 296, 288, 16/278

[56] References Cited

U.S. PATENT DOCUMENTS 4,226,001 10/1980 Salice ..... 16/296
4,543,686 10/1985 Rock et al. ..... 16/291
4,654,930 4/1987 Lautenschlager, Jr. et al. .... 16/291

FOREIGN PATENT DOCUMENTS 2408057 8/1975 Fed. Rep. of Germany ..... 16/294

*Primary Examiner*—Nicholas P. Godici
*Assistant Examiner*—Carmine Cuda

[57] ABSTRACT

Over-center self-closing hinge for cabinet doors, having an inner link and an outer link in a quadrilateral arrangement and a lever in the form of a hairpin spring fulcrumed at one end in the cabinet-wall-related hinge part and thrusting at right angles to the hinge axis against a cam which is journaled on the inner link and abuts in its one position against the pivot eye of the latter and in its other position against the link itself. The cam is of such a configuration that, when the hinge is moved from the open position to the closed position, just before it reaches the closed position, the line of thrust applied by the hairpin spring passes through the pivot axis of the link, but then the spring passes over onto a portion of the cam associated with the second position of the latter, thereby causing the cam to rock over and alter the line of thrust of the spring such that it seeks to close the hinge.

6 Claims, 1 Drawing Sheet

OVER-CENTER SELF-CLOSING HINGE FOR CABINET DOORS

BACKGROUND OF THE INVENTION

The invention relates to an over-center self-closing hinge for cabinet doors, having a quadrilateral linkage, a single-arm lever which is mounted at its one end in the cabinet-wall-related part of the hinge and is constituted by a leaf spring which can flex in a plane at right angles to the hinge axis and thrusts against a cam which is disposed on the inner link (the one closer to the wall) and extends as far as the pivot eye on the link's end nearer the wall, the cam being rotatable on a pivot such that in the end positions of the hinge it comes to rest in two different positions on the inner hinge link.

In one known hinge (U.S. Pat. No. 4,654,930) of this kind, the cam which, in an improvement on an older form (DE-OS 24 08 057), can rotate relative to the inner hinge link, is mounted on a pivot held in the sides of the wall-related hinge part which is an elongated supporting arm of inverted U-shaped cross section Since the cam on the other hand is carried displaceably on the inner hinge link, during the opening or closing movement of the hinge it performs a positively controlled rotatory movement, i e , with each position of the hinge there is positively associated a certain position of the cam body. The swinging movement of the inner hinge link is in this case transmitted to the cam body such that it performs a definitely greater movement relative to the end of the spring biased against it than the cam of the above-mentioned older hinge in which the cam is fixedly joined to the inner hinge link. The positive control of the rotation of the cam makes it possible to increase the effective length of the cam cooperating with the end of the spring, and accordingly also to achieve a relatively greater spring stroke, so that, in comparison to the above-mentioned older hinges, higher end-position retaining forces can be achieved without stronger springs, or equal end-position retaining forces can be achieved with weaker springs. The start of the over-center action, i.e., of the closing torque, when a door mounted on a cabinet carcase with the known hinges approaches the closed position, does not take place abruptly, but gradually, because an abrupt production of the closing torque would require too great a change in the curvature of the cam in the dead-center range, i.e., a portion of the edge of the cam would, in the course of time, be subject to more wear than the other portions. The closing characteristic of the known hinge would therefore also change in the course of time.

It is thus the purpose of the invention to create an over-center self-closing hinge which can turn through most of its range in an effortless and torque-free manner, but at a specific position, just before the closed position is reached, a comparatively strong closing torque spontaneously begins.

SUMMARY OF THE INVENTION

Setting out from a hinge of the kind described above, this purpose is accomplished in accordance with the invention in that the cam is journaled in a pair of ears bent up from the opposite longitudinal margins of the inner hinge link and reaching into the area between the two hinge links such that the cam becomes a rocking lever on which the end which is engaged by the spring on the side opposite the hinge link is rocked against the inner hinge link; in that the pivot of the cam is so disposed in relation to the pivot axis at the supporting-arm end of the inner hinge link, that, when the hinge moves from the open to the closed position and nears the closed position, a plane passing through the two pivot axes intersects the cam in the area of contact with the spring, and the direction of the action of the spring force exerted by the spring on the cam edge is applied approximately in this plane; in that, in the hinge movement from the open position to the closed position, up to the line of intersection with the plane passing through the pivot axes, the section of the cam upon on which the spring acts has a lateral profile of a substantially arcuate shape and the arc is substantially centered upon the pivot axis of the supporting-arm end of the inner hinge link, and that the section of the cam edge adjoining the section acted upon by the spring in the remaining closing movement has such a shape that the force exerted by the spring on this section of the cam produces a thrust in the closing direction on the inner hinge link.

Therefore, the cam is not positively and continuously rotated in accordance with the position of the hinge, but cooperates with the corresponding spring either in the one or in the other hinge end position. The rotation of the cam from the one to the other end position takes place abruptly, as soon as the free end of the spring passes over from the section of the cam that is arcuate in lateral profile and concentric with the pivot axis of the inner hinge link, to the second section of the cam, i.e., the cam rocks abruptly from the one to the other position with no great relative movement the engaging end of the spring on the cam. On the other hand the shape of the cam and accordingly also the direction of action of the spring force abruptly changes, so that the closing torque begins spontaneously and energetically in the desired manner.

The cam has preferably a width corresponding approximately to the free distance between the bent ears. The free end of the leaf spring can thus be made of a corresponding width, so that the stresses acting between the cam and the free end of the spring can be kept relatively low and premature wear-out of the cam is prevented.

The spring is preferably a leaf spring whose one end is fastened in the supporting arm and whose other, free end lies upon the cam, the free end of this leaf spring — again to reduce wear — terminates in a rounded end.

The portion of the leaf spring lying between the rounded end and the section fastened in the supporting arm, however, can best have a curvature in the same direction as that of the cam edge, so that, when the hinge is rotated from the closed to the open position, the cam can enter into the concave portion of the leaf spring.

The ears holding the pivot of the cam are made integral with the margins of the inner hinge link, in a preferred embodiment of the invention, i.e., the inner hinge link is stamped in one piece from an originally flat piece of metal and then finished by bending the ears cut on the sides upward at right angles to the margins.

The cam in turn is best made of plastic, using a plastic which has, on the one hand, sufficient resistance to wear, and on the other hand has good sliding properties in conjunction with the free end of the spring.

BRIEF DESCRIPTION OF THE DRAWINGS

The invention will be further explained in the following description of an embodiment in conjunction with the drawing, wherein.

DESCRIPTION OF PREFERRED EMBODIMENT

Figure 1:
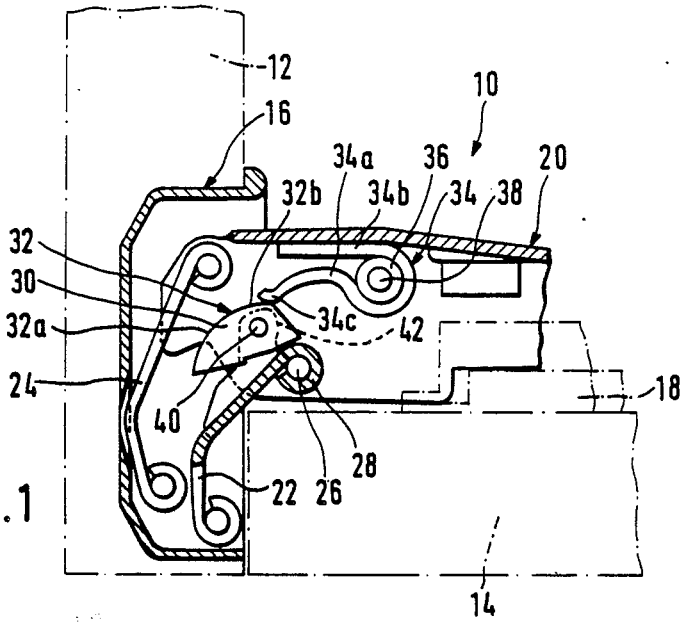
FIG. 1 is a longitudinal central section through an over-center self-closing hinge constructed in the manner of the invention, in the closed state.
Figure 2:
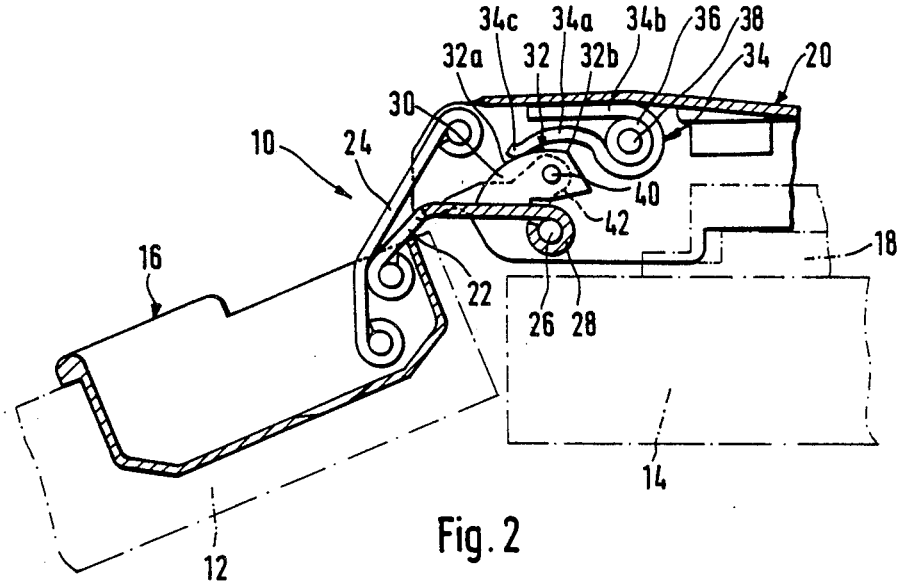
FIG. 2 is a sectional view corresponding to FIG. 1, of the hinge in the open state.

The over-center self-closing hinge shown in FIGS. 1 and 2 and identified as a whole by the numeral 10 serves for hanging a door 12 on the wall 14 of a cabinet carcase. The door and the wall are represented in dash-dotted lines in the figures, since they have nothing to do with the configuration of the over-center hinge in accordance with the invention. The hinge 10 consists in a known manner of a door-related part in the form of a cup 16 which can be set in a mortise in the back of the door 12. The cup is coupled, by two links 22, 24, to an elongated, channel-shaped piece attached displaceably to a mounting plate 18 likewise indicated in dashdotted lines, which in turn is affixed to the wall 14. The over-center mechanism has a cam 30 disposed adjacent the wall end of the inner link 22, i.e., the link that is closer to the cabinet interior when the door is closed. The edge 32 of the cam confronts the outer link 24 and faces the web of the channel-shaped supporting arm 20. The free end of a single-arm lever rotating at right angles to the hinge pivot axis engages, under bias, the cam edge or track 32. In the present case this one-armed lever is constituted by a portion **34*a* of a leaf spring 34 bent to an approximate U shape, whose other end 34*b* thrusts against the bottom of the web of the supporting arm 20. The leaf spring 34 is held in the represented position with its free ends pointing away from the carcase interior by a pin 38 held in the sides of the supporting arm 20 and provided with a roller-like bearing 36 to adapt it to the arcuate transition between the spring legs 34*a*, 34*b*. The assembly of the leaf spring 34 is performed simply by placing it onto the pin 38 and its bearing 36; the arcuate transition between the legs 34*a*, 34*b*, of the leaf spring 34 grips the bearing 36** on an angle of more than 180°, preventing any unintentional release of the leaf spring.

The cam 30 itself is pivotally mounted on a pin 40 whose ends are held in ears 42 cut on the lateral margins of the inner hinge link 22 and bent at right angles toward the outer hinge link 24 and the web of the supporting arm 20. The cam can therefore, like a rocking lever, be rocked from one to the other end position, the bottom of one end of this rocking lever being then supported on the inner hinge link, whenever the free end of the limb **34*b* of leaf spring 34 thrusts under bias against the top edge of the same end. The cam edge 32 itself is divided into two sections 32*a* and 32*b*, of which the longer section 32*a* pointing away from the carcase interior is arcuately curved in lateral profile, such that the arc is concentric with the pivot axis on the supporting arm end of the inner link 22 when the free end of spring limb 34*a* rests on it, i.e., the bottom of the cam lever 30 pointing away from the carcase interior is supported on the hinge link 22. The arcuate section 32*a* of the cam track 32 runs in the direction of the interior of the carcase, at least up to an imaginary plane running through the central axes of the pivot pins 26 and 40, and the length of the spring limb 34*a*, which is bent at the free end at 34*c* to a curvature which is the opposite of that of the cam surface 32 is at the same time selected so that it will rest on the line where the said imaginary plane intersects with the cam edge 32 precisely when the hinge, in the closing movement, comes close to the closed position — for example to a remanent angle of about 10° to 20°. At this point the line of action of the spring force exerted by the spring limb 34*a* on the cam edge 32 runs through the central axis of the pivot pin 40 and simultaneously through the central axis of pivot pin 26, so that the spring bias can produce no thrust in the closing or in the opening direction. When the end section 34*c*, however, in the continued hinge-closing movement, passes over onto the cam edge section 32*b*, the spring force acts on the cam with leverage with respect to the pivot pin 40, and the cam rocks to the second end position in which its arm pointing toward the carcase interior is supported on hinge link 22 adjacent the pivot eye 28. Thus, the cam edge section 32*b* changes position such that the line of action of the spring force exerted by the end section 34*c* of the leaf spring limb 34*a* passes between the central axes of the pivot pins 40 of cam 30 and of pivot pin 26 of the inner hinge link 22**.

The spring force therefore acts on the inner hinge link with leverage with respect to the central axis of the pivot pin 26 and thus produces a thrust on the inner hinge link in the closing direction of the hinge. Since the rocking of the cam 30 from the one end position to the other takes place very rapidly as soon as the dead center position is passed, the closing thrust is produced very spontaneously in the desired manner, so that a door 12 hung with hinges 10 on a cabinet carcase is forced rapidly and emphatically into the fully closed position. The cam 30 is best made of a plastic that is resistant to wear and has good sliding qualities, its width being such as to correspond substantially to the width of the inner hinge link 22. The danger of wear on the cam edge 32, and thus of change in the closing characteristic by the friction developing between the cam and the curved end section **34*c* of the leaf spring limb 34*a* when the hinge is in motion, is thus minimized, inasmuch as the transition of the cam section 32*a* to cam section 32*b*** is constant, i.e., it is not an edge that is subject to wear to any particular extent.

I claim:

1. An over-center self-closing hinge comprising: a wall-related part having means for attachment to a wall of a cabinet, a door-related part for attachment to a door of a cabinet, a first hinge link, and a second hinge link, a first shaft pivotally connecting said first hinge link to said wall-related part, a second shaft for pivotally connecting said first hinge link to said door-related part, means for pivotally connecting said second hinge link to said wall-related part and to said door-related part, said first hinge link being closer to said means for attachment to the wall than said second hinge link, a single-arm lever forming a compression spring and having a stationary end journaled in said wall-related part and also having a free end, a cam body having a cam edge engaged by said free end of said single-arm lever of said compression spring, a third shaft for pivotally supporting said cam body in said wall-related part, said third shaft being journaled on two ears provided laterally on opposite longitudinal margins of the first hinge link and bent into the area between the two hinge links such that the cam body forms a two-armed lever, said two-armed lever being engaged by the spring on the side opposite the first hinge link; when seen in side view, said cam edge having a first section of substantially arcuate shape substantially concentric with said first shaft, a second section adjoining said first section, the third shaft being so disposed in relation to the first shaft that when the hinge moves from the open to the closed position and nears the closed position, a plane passing through the first and third shafts intersects said cam edge in the area of contact with the spring and the direction of action of the spring force exerted by the spring on the cam edge is applied approximately in said plane; in the hinge movement from the open position to the closed position, up to the line of intersection with the plane passing through the first and third shaft, at the beginning the first section of the cam edge is acted upon by the engaging spring, said second section of the cam edge being acted upon by the spring in the remaining closing movement, said second section having such a shape that the force exerted by the spring on said second section exerts a torque on the first hinge link in the hinge-closing direction.

2. A hinge in accordance with claim 1, wherein the cam body has a width corresponding approximately to the free distance between the ears.

3. A hinge in accordance with claim 1, wherein the spring is a leaf spring having one end fastened in the wall-related part, and another, free end bearing upon the cam edge, the free end of the leaf spring terminating in an end section bent in a direction opposite that of the curvature of the cam edge.

4. A hinge in accordance with claim 3, wherein a portion of the leaf spring lying between the bent end section and the end fastened in the wall-related part has a curvature of the same sense as the curvature of the cam edge.

5. A hinge in accordance with claim 1, wherein the ears are integral with margins of the first hinge link.

6. A hinge in accordance with claim 1, wherein the cam body consists of plastic.

* * * * *